US008596496B2

(12) United States Patent
Malinski

(10) Patent No.: US 8,596,496 B2
(45) Date of Patent: Dec. 3, 2013

(54) WINE STORAGE AND DISPENSING APPARATUS

(75) Inventor: Jon M. Malinski, Paradise Valley, AZ (US)

(73) Assignee: Vinocopia, Inc., Richfield, MN (US)

( * ) Notice: Subject to any disclaimer, the term of this patent is extended or adjusted under 35 U.S.C. 154(b) by 153 days.

(21) Appl. No.: 13/189,034

(22) Filed: Jul. 22, 2011

(65) Prior Publication Data

US 2012/0018450 A1 Jan. 26, 2012

Related U.S. Application Data

(60) Provisional application No. 61/366,877, filed on Jul. 22, 2010.

(51) Int. Cl.

| | |
|---|---|
| ***B65D 35/56*** | (2006.01) |
| ***B67D 7/80*** | (2010.01) |
| ***B67D 7/06*** | (2010.01) |
| ***B67D 3/00*** | (2006.01) |
| ***F25B 21/02*** | (2006.01) |
| ***F25D 3/00*** | (2006.01) |
| ***F25D 3/08*** | (2006.01) |

(52) U.S. Cl.

USPC ..... 222/105; 222/146.6; 222/185.1; 222/523; 62/3.64; 62/396; 62/457.8

(58) Field of Classification Search

USPC ..... 222/105, 146.1, 146.6, 185.1, 523, 183; 62/371, 389, 396, 3.6, 457.8, 3.64

See application file for complete search history.

(56) References Cited

U.S. PATENT DOCUMENTS

| | | | | |
|---|---|---|---|---|
| 2,116,622 | A * | 5/1938 | Eisenmenger | 261/122.1 |
| 2,831,610 | A * | 4/1958 | Dennie | 222/105 |
| 3,243,965 | A * | 4/1966 | Jepson | 62/3.64 |
| 3,476,295 | A * | 11/1969 | Telfer | 222/183 |
| 3,696,969 | A | 10/1972 | De Van et al. | |

(Continued)

FOREIGN PATENT DOCUMENTS

| | | | |
|---|---|---|---|
| JP | 2003-534997 | A | 11/2003 |
| JP | 2007-091334 | A | 4/2007 |
| KR | 2003-0015255 | A | 2/2003 |

OTHER PUBLICATIONS

JP 2007091334 Full Translation.*

(Continued)

*Primary Examiner* — Paul R Durand
*Assistant Examiner* — Matthew Lembo
(74) *Attorney, Agent, or Firm* — DuFault Law Firm, P.C.; Dustin R. DuFault

(57) ABSTRACT

An apparatus for storing and dispensing wine comprises a housing formed substantially in the shape of a wine barrel. The housing including a circumferential wall, a first closed end and a second open end. A spigot for selectively dispensing wine is supported by and positioned through the first closed end of the housing. A removable insert disposable within the housing through the second open end contains a collapsible bladder of wine. A wine dispensing port is contained within the bladder and insert. With the insert positioned within the housing, the port is positioned proximate the second open end thereof. A conduit in fluid communication with the spigot extends from the first closed end toward the second open end. Upon disposing the insert within the housing, the conduit is connectable to the port wherein the wine can be selectively dispensed from the spigot.

10 Claims, 6 Drawing Sheets

(56) References Cited

U.S. PATENT DOCUMENTS

| | | | | |
|---|---|---|---|---|
| 3,712,514 | A * | 1/1973 | LeBlanc | 222/146.6 |
| 3,760,711 | A | 9/1973 | Webster | |
| 3,933,275 | A * | 1/1976 | Metzner et al. | 222/131 |
| 4,105,139 | A | 8/1978 | Scholle | |
| 4,164,851 | A | 8/1979 | Bryant | |
| 4,304,341 | A | 12/1981 | Shirley | |
| RE32,354 | E | 2/1987 | Savage | |
| 4,901,886 | A * | 2/1990 | Kirschner | 222/1 |
| 4,921,135 | A * | 5/1990 | Pleet | 222/82 |
| 5,373,872 | A | 12/1994 | Mueller | |
| 5,469,708 | A * | 11/1995 | Harrison et al. | 62/3.64 |
| 5,634,343 | A * | 6/1997 | Baker, III | 62/3.64 |
| 6,056,157 | A * | 5/2000 | Gehl et al. | 222/94 |
| 6,250,506 | B1 * | 6/2001 | Geiger et al. | 222/105 |
| 6,334,329 | B1 | 1/2002 | Weller | |
| 7,178,343 | B2 | 2/2007 | Linder | |
| 7,258,252 | B2 | 8/2007 | Waters | |
| 7,434,705 | B2 * | 10/2008 | Evangelista | 222/105 |
| 2002/0162339 | A1 * | 11/2002 | Harrison et al. | 62/3.7 |
| 2004/0144799 | A1 * | 7/2004 | Danby et al. | 222/94 |
| 2006/0112717 | A1 | 6/2006 | Walton | |
| 2007/0245765 | A1 | 10/2007 | Casher | |
| 2007/0284389 | A1 | 12/2007 | Jacobs | |
| 2008/0087682 | A1 | 4/2008 | Overgaard | |
| 2009/0250489 | A1 | 10/2009 | Saunders et al. | |
| 2010/0147884 | A1 * | 6/2010 | Compton et al. | 222/105 |

OTHER PUBLICATIONS

Notification of Transmittal of the International Search Report and The Written Opinion of the International Searching Authority, Or the Declaration, PCT/US2011/044966, Mar. 8, 2012, Korean Patent Office, International Searching Authority.

International Preliminary Report on Patentability, PCT/US2011/044966, Jan. 22, 2013.

* cited by examiner

WINE STORAGE AND DISPENSING APPARATUS

CROSS-REFERENCE TO RELATED APPLICATION(S)

The present application claims a benefit of U.S. Provisional Application No. 61/366,877 filed on Jul. 22, 2010, which is hereby incorporated herein in its entirety by reference.

BACKGROUND OF THE INVENTION

The present invention generally relates to wine storage devices. More particularly, the present invention relates to an apparatus for storing and dispensing wine from collapsible, reusable containers.

For many years, wine has remained one of the most popular drinks to accompany a meal, and as such, is made available not only at home, but at a vast number of restaurants. It is therefore important for a restaurant to keep in stock ample quantities of wine to meet the demand of its customers. However, as wine has historically been stored within glass 750-mL bottles, not only are there increased shipping costs associated with the use of glass bottles, but stocking a restaurant with such wine requires certain space requirements. Alternatively, certain types of wine have been made available by means of portable fluid containers, for example flexible 3- to 10-liter bladders of wine contained within a cardboard box, sometimes referred to as "wine-in-a-box" or simply "box wine". While such containers cut down on shipping costs, there are still storage considerations to take into account, as well as other inherent setbacks. For instance, as the box itself must be placed within a refrigeration unit to keep the wine chilled, the refrigeration space required for the box must be considered. Further, and regardless if a bottle or portable fluid bladder is used, once opened, the shelf-life of the wine decreases rapidly due to oxidation. While bottles of wine typically have to be consumed within a day or so, "wine-in-a-box" products currently available typically last only about a week. More importantly, though, as wine is considered by many to be a premium product, "wine-in-a-box" does not do well from a marketing standpoint as it has been perceived by the purchasing public to be an inferior product or inferior means of storage as opposed to glass bottles. For this reason alone, many vintners have avoided providing wines in this fashion, preferring instead to stick with glass bottles.

There exist in the art several examples of devices which have attempted to provide a means for storing box wine in an aesthetically pleasing manner. However, limitations exist in such examples as conventional devices have been shown to be quite difficult to change between spent wine bladders and new ones. For example, U.S. Pat. No. 7,434,705 requires that a front end housing containing a dispensing spout be removed before a spent bladder of wine can be replaced with a full bladder of wine. It has been shown in the field that this mechanism is difficult to employ.

Currently, there exists a need in the art to provide an aesthetically pleasing wine dispensing mechanism for use in conjunction with reusable bladders of wine which provides a quick, easy and efficient means of changing between spent and full bladders. There also exists a need in the art to provide a wine dispensing mechanism which assists in preserving unused quantities of wine after opening longer than what is currently available.

BRIEF SUMMARY OF INVENTION

In accordance with the present invention, an apparatus is provided for refrigerating and dispensing pre-packaged wine.

The apparatus includes a housing formed substantially in the shape of an aesthetically pleasing miniature wine barrel which holds a removable insert containing between approximately 3 and 10 liters of wine within a collapsible bladder. The housing includes a first circumferential wall, a front face and removable rear panel. A spigot for selectively dispensing the wine is supported by and positioned through the front face. The insert is disposable within the housing through the rear portion with the panel removed. A telescoping conduit in fluid communication with the spigot extends from the front face of the housing to the rear thereof for connection with the insert proximate the rear of the housing. The conduit is positionable between a first retracted position and a second extended position, which facilitates in connecting the bladder thereto.

In replacing a spent bladder, the user removes the rear cover and pulls the insert out slightly such that the connection between the conduit and the insert is easily accessible to the user. This extends the conduit from the first retracted position to the second extended position. The user can then disconnect the spent insert from the conduit, fully remove the spent insert, which can then be replaced by a full insert. The full insert is connected to the conduit and then fully positioned within the housing, which positions the telescoping conduit from the second extended position to the first retracted position. The panel can then be replaced and the apparatus is ready to again dispense wine.

To optionally cool the wine, an electric heat pump extends through an aperture contained within a bottom portion of the housing. The heat pump is capable of expelling thermal energy contained within the housing to keep the wine cool relative to a higher ambient temperature. To facilitate in the cooling of the wine, a thermally conductive shroud is provided which is supported by a thermal conductive block in communication with the heat pump. The shroud is configured to receive and support the insert. Both the shroud and the insert have an angled floor which permits the wine to be gravitationally urged toward the rear of the housing where the conduit fluidly connects to the bladder.

BRIEF DESCRIPTION OF THE DRAWINGS

The following figures are used herein in conjunction with the specification to assist in understanding the invention. The Figures are as follows.

DESCRIPTION OF THE INVENTION

Figure 1:
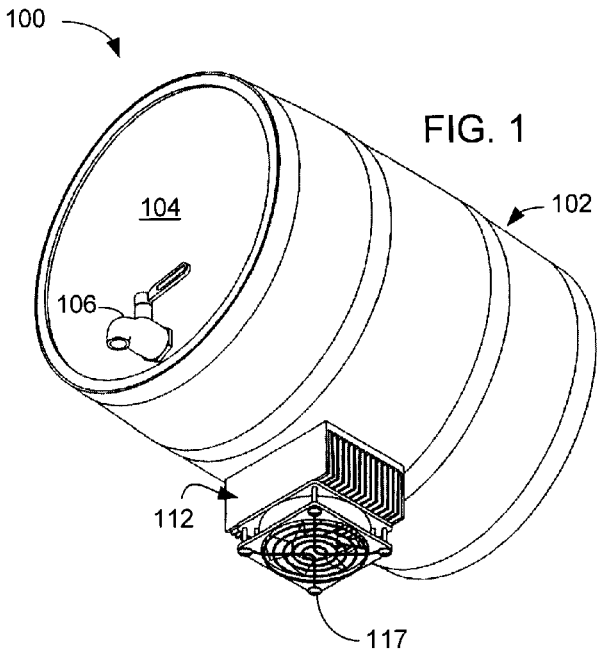
FIG. 1 is a perspective view of a wine storage and dispensing apparatus in accordance with a first embodiment of the present invention.
Figure 2:
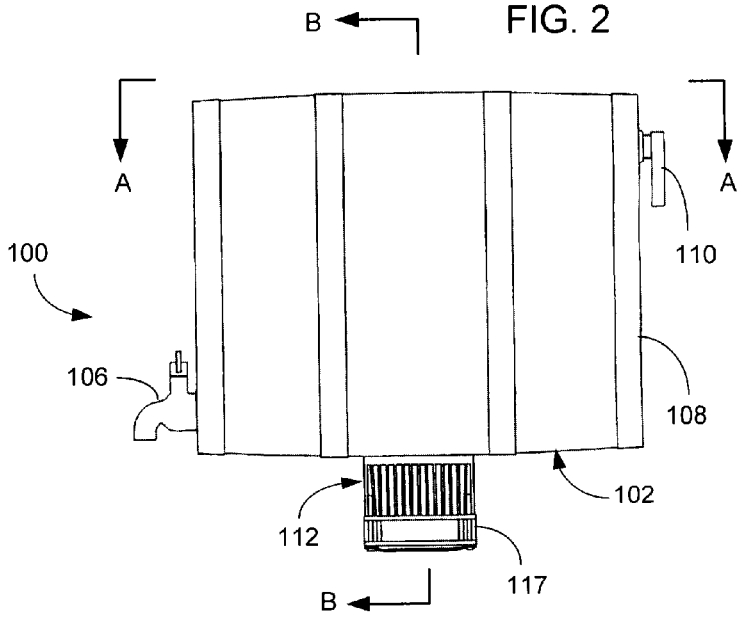
FIG. 2 is a side-view of the wine storage and dispensing apparatus in accordance with the first embodiment of the present invention.

A wine storage and dispensing apparatus of the present invention is generally indicated at 100 in FIGS. 1 through 4. The apparatus 100 includes a housing structure 102, preferably an aesthetically shaped miniature wooden wine barrel, for placement on or near a bar in areas where wine would normally be dispensed. However, it should be noted that alternative shapes for the housing structure are well within the scope of the present invention, including non-exhaustive examples of semi-circular barrels with flat bottoms, rectangular boxes or the like. The wine barrel 102 includes a front face 104 which supports a spout or spigot 106 for selectively dispensing wine. A removable back panel 108 attaches to the wine barrel 102 by means of a latching mechanism 110. The specific latching mechanism 110 employed is not critical in practicing the invention, and those skilled in the art will recognize that other mechanisms than those illustrated will suffice.

Figure 4:
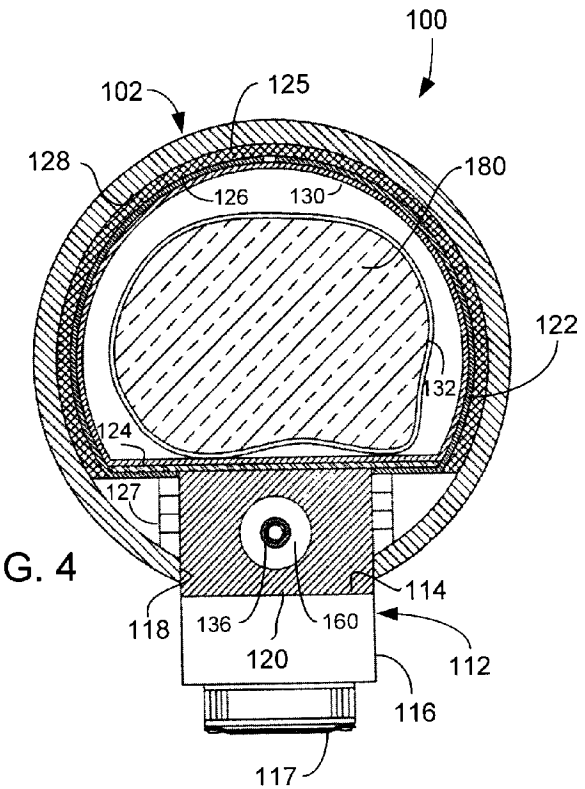
FIG. 4 is a cross-sectional view of the wine storage and dispensing apparatus as taken along lines B-B in FIG. 2.
Figure 3:
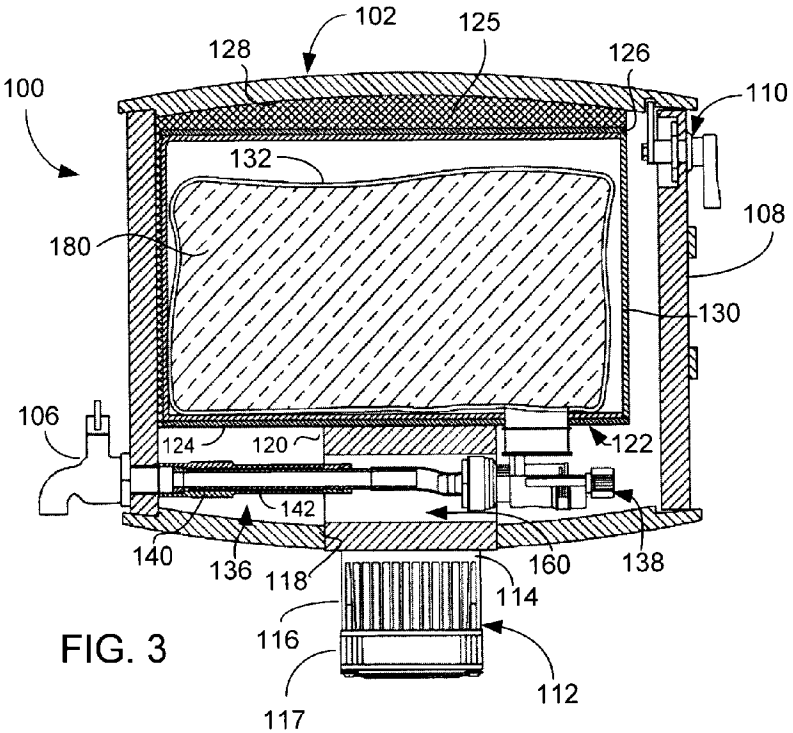
FIG. 3 is a cross-sectional view of the wine storage and dispensing apparatus as taken along lines A-A in FIG. 2.
Figure 5:
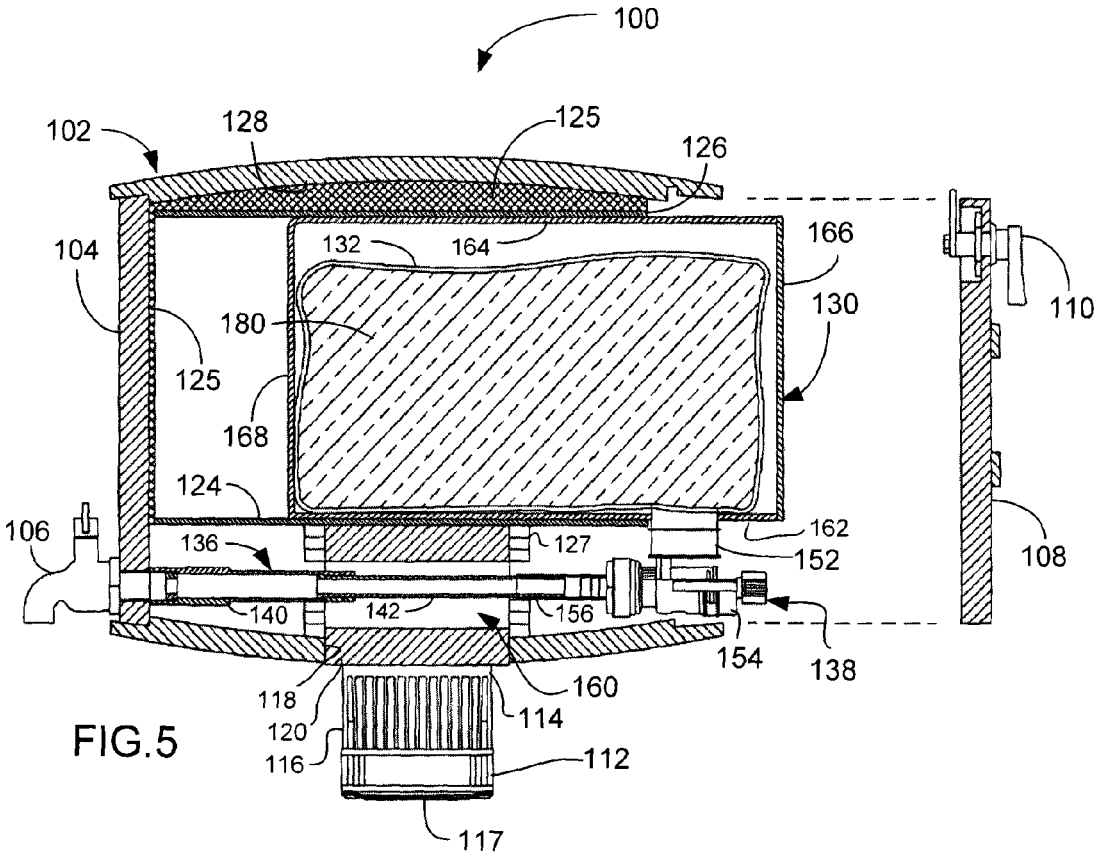
FIG. 5 is a cross-sectional view of the wine storage and dispensing apparatus of the present invention with an insert partially removed.

The apparatus 100 further includes an optional thermoelectric heat pump 112 for cooling wine contained within the barrel 102. The thermoelectric heat pump 112 for use with the present invention includes a solid-state active heat pump which transfers heat from one side 114 of the device to the other side 116 against a temperature gradient with the consumption of electrical energy. A heat sink 117 effectuates dissipation of heat into the air. As best illustrated in FIGS. 3 through 5, the thermoelectric heat pump 112 is positionable through an aperture 118 contained in an under portion of the housing. As it is contemplated that in most situations the a ambient temperature of the room or restaurant where the apparatus 100 will be dispensing wine will be greater than optimal wine dispensing temperatures of between 45 and 65 degrees Fahrenheit, the heating portion 116 of the thermoelectric cooler seats outside of the barrel 102, enabling any generated heat to dissipate into the outside air. Attached to the cooling side 114 of the heat pump is a thermally conductive block 120, preferably constructed of a metallic material such as aluminum. However, any material having a thermal conductivity greater than about 100 watts per meter Kelvin (W/(m*K)) is well within the scope of the present invention. The thermoelectric heat pump 112 further includes a control unit and electric transformer (not shown) for activating and controlling the temperature of the block 120 and shroud 122, which in turn controls the temperature of the wine. Exemplary thermoelectric heat pumps 112 for use with the present invention include those as made available by Pacific Supercool, Ltd. of Bangkok, Thailand or SOS Prescott of Prescott, Wis. However, one skilled in the art will recognize that the use of similar thermoelectric heat pumps by other manufacturers are well within the scope of the present invention.

To increase the efficiency and the consistency of the manner in which heat is conducted out of the wine barrel 102, and to provide for a more consistent temperature therein, the metallic shroud 122 is provided. The shroud 122 seats upon and engages the conductive block 120. The metallic shroud includes a base plate 124 attached to the conductive block 120, as well as a semi-circular wall 126 extending along longitudinal edges of the base plate 124. Insulation 125 may be provided between the shroud 122 and the inner wall 128 of the barrel. Further, thermal electric compound 127, such as thermal grease, may be optionally included between the conductive block 120 and the inner wall 128, as is illustrated in FIG. 5. The shroud 122 is designed to support a removable plastic insert 130 containing a collapsible bladder 132 of wine.

Figure 6:
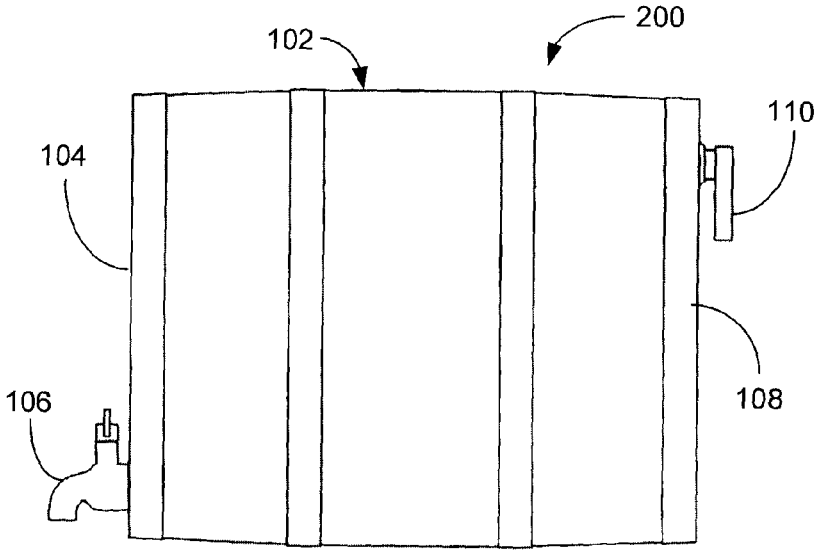
FIG. 6 is a side-view of the wine storage and dispensing apparatus in accordance with a second embodiment of the present invention.

As mentioned, use of the thermoelectric heat pump 112 is optional and the present invention can be practiced without such a device, as is illustrated in alternative embodiment 200 in FIG. 6. However, for purposes of this description, similar parts from apparatus 100 and alternative apparatus 200 will be given similar references, and any differences between the two embodiments will be explicitly stated. As such, unless otherwise noted, description of one is meant to include description of the other for similar parts and operation.

Figure 7:
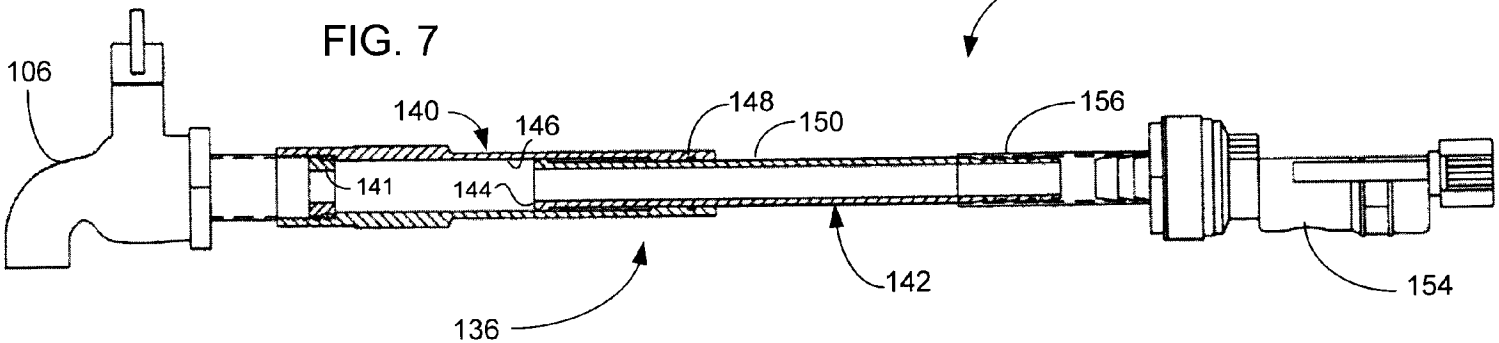
FIG. 7 is a partial cross-sectional side view of a dispensing system in accordance with the present invention.
Figure 8:
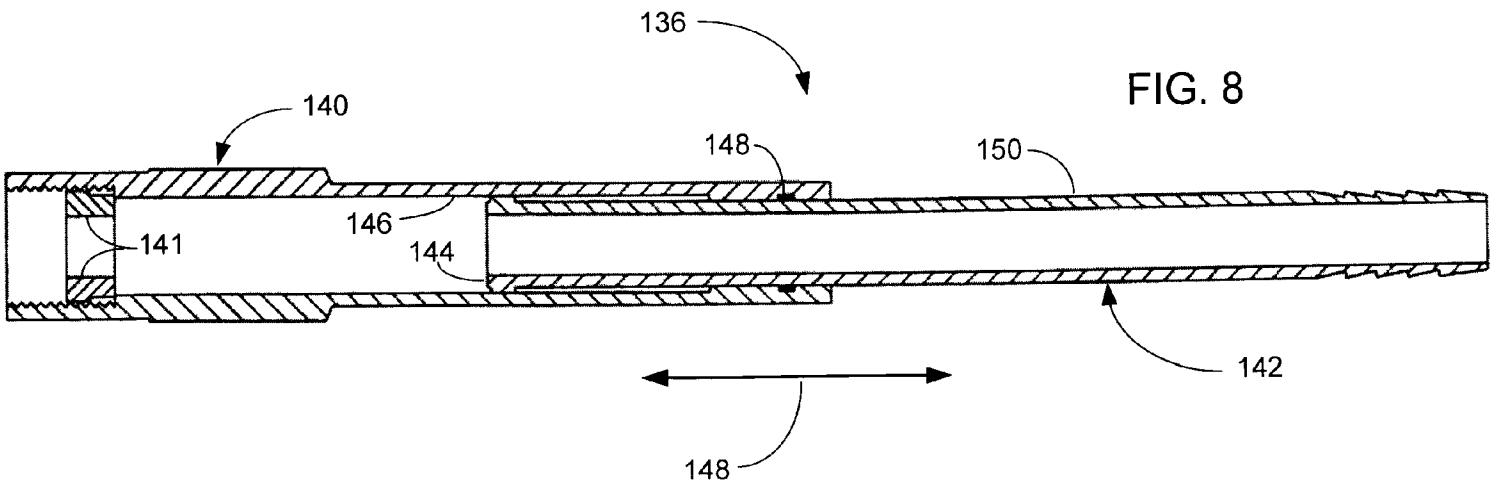
FIG. 8 is a cross-sectional view of a telescoping conduit in accordance with the present invention.

To transfer the wine contained within the bladder 132 positioned within the insert 130, a liquid transfer mechanism 134 is provided. As illustrated in FIG. 7, the liquid transfer mechanism 134 includes the spigot 106 in fluid communication with a telescoping conduit 136, which in turn fluidly connects to a quick connector 138. The spigot 106, as made available by Artisan Barrels of Oakland, Calif., threadably attaches to a first segment 140 of the telescoping conduit 136, wherein a seal is formed by means of a washer 141. As illustrated in FIG. 8, the telescoping conduit includes the first segment 140 into which slidably disposes a second segment 142, as denoted by arrow 143. The second segment 142 is therefore of a lesser diameter than the first segment 140. Both the first segment 140 and the second segment 142 are preferably constructed of a rigid material, for example stainless steel. The second segment 142 is slidably positionable relative to the first segment 140 to increase or decrease the overall length of the telescoping conduit 136, the importance of which will become apparent shortly. In order to prevent leakage of liquid when passing therethrough, and to prevent the intrusion of any unwanted material therein, the second segment 142 includes a flange 144 extending circumferentially and slidably engaging an inner surface 146 of the first segment 140. Additionally, an O-ring 148 is positionable within a groove contained in the first segment 140. The O-ring 148 abuts against an outer surface 150 of the second segment 142, which further enhances the seal between the first segment 140 and the second segment 142.

The quick connect 138 is preferably a VITOP® BAG-IN-BOX® quick connect as made available by the Smurfit Kappa Group of Eperny, France. The quick connect 138 includes a male and female connector, 152 and 154 respectively. The female connector 154 connects to the second segment 142 by means of a flexible length of tubing 156. The tubing 156 is preferably anti-microbial to prevent the intrusion of microorganisms into the wine which can lead to the spoilage thereof. The male connector 152 attaches to the bladder 132 and seats within an aperture 158 contained within the insert 130. The telescoping conduit 136, as well as the connecting tube 156 and a portion of the quick connect 138, is disposable within a circular channel 160 contained within the conducting block 120 as illustrated in FIGS. 3 and 4.

Figure 9:
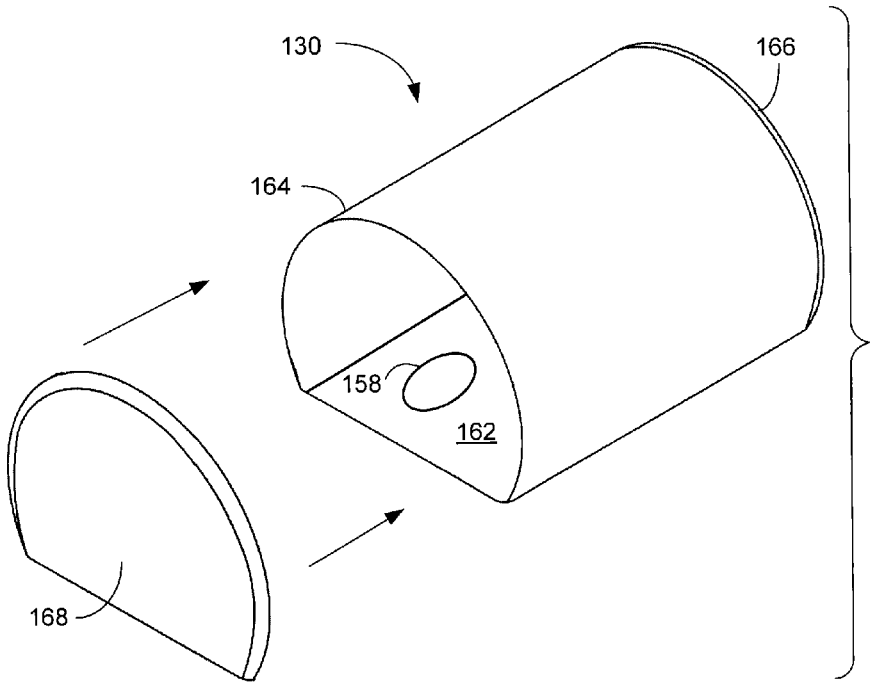
FIG. 9 is an exploded perspective view of a reusable container in accordance with the present invention.
Figure 10:
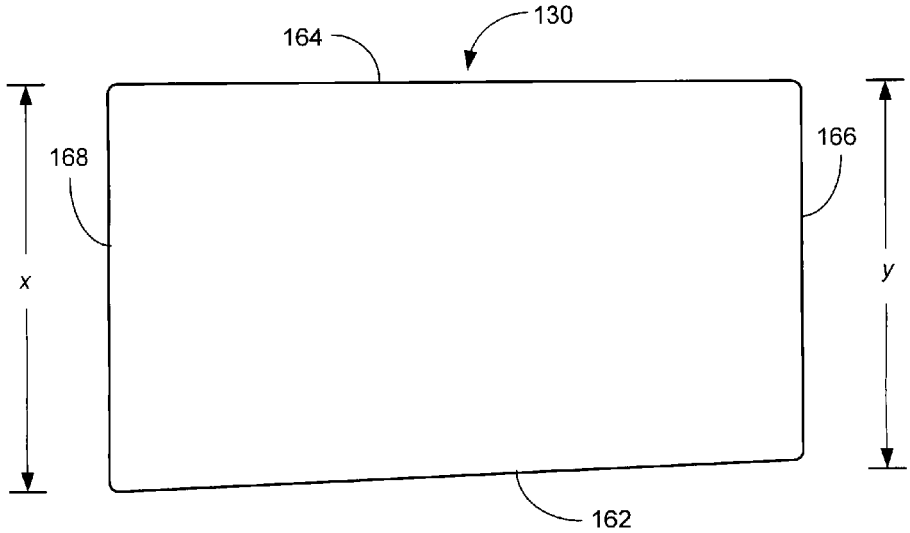
FIG. 10 is a side profile view of the reusable container in accordance with the present invention.

Referring now to FIG. 9, the removable insert 130 is constructed from plastic and includes a substantially flat rectangular floor 162 containing the circular aperture 158 for receiving the male connector 152. A semi-circular wall 164 extends from opposing longitudinal sides of the bottom 162. The semi-circular wall 164 and bottom 162 are joined on a first end by an end-wall 166. A removable cap 168 is securable to a second end portion of the bottom 162 and semi-circular wall 164. The insert 130 houses the collapsible bladder 132 which is fillable with liquid, which in this case includes wine. The male connector 152 fluidly communicates with the bladder 132 and provides the wine to the liquid transfer mechanism 134 when connected thereto. Both the end wall 166 and removable cap 168 include a semi-circular design with a bottom flat portion such that the insert conforms to the shape of the barrel 102 and is disposable within the shroud 122. In order to facilitate gravitational draining of the bladder contents during use, the cap 168 includes a larger circular radius x than a circular radius of the end-wall y, giving the semi-circular wall 164 a frusto-conical configuration. With the end-wall 166 and cap 168 being positioned substantially parallel to one another, the floor 162 therefore is positioned at a declining angle from the end-wall 166 as the floor 162 proceeds towards the cap 168 relative to the top of the semi-circular wall 164, as illustrated in FIG. 10. As the shroud 122 is configured to receive the insert 130, it should be understood that the base plate 124 also includes a corresponding declination.

As is known in the art, the bladder 132 may is constructed of a flexible material such that it may collapse upon itself when the contents therein are drained. Such materials can include metallic sheeting or plastic formed to provide a hermetically sealed interior. To fill the bladder 132, all air is first evacuated after which the wine is introduced therein. Upon being filled, the bladder 132 is injected with an overpressure of an inert gas, such as Argon, to prevent oxygenation of the wine and thereby extend shelf life. Further, by filling the bladder 132 with an inert gas, it has been discovered that the wine can remain unspoiled after opening for a much longer time than is observed within conventional wine-in-a-box methods. Instead of less than two weeks, which is typical for a conventional device, the wind dispensing apparatus 100 of the present invention can prevent oxygenation and spoiling of the wine after opening for up to eight weeks.

It is intended that either the vintner or the wine wholesaler fills the bladders 132 with wine, along with the overpressure of inert gas prior to sealing the bladder 132 within the insert 130. The insert 130 thereby provides a protecting structure to prevent the bladder 132 from being punctured during transit or use. The vintner or wholesaler then ships the insert, or a plurality of inserts, directly to the restaurant when they can be stored until needed for dispensing.

In operation, the apparatus 100 or 200 containing an insert with wine contained therein is positioned within a restaurant, home or other suitable place where it is convenient to dispense the wine into individual glasses when so desired. Upon depleting the contents of a bladder 132, whereby the wine insert needs to be replenished, the back cover 108 of the housing 102 is removed. As illustrated in FIG. 6, the user pulls the insert 130 partially from the shroud 122, causing the second segment 142 of the telescoping conduit to withdraw from the first segment 140 and allowing the user access to the quick connector 138. The user then removes the male connector 152 from the female connector 154, whereby the insert 130 is fully removable from the shroud 122 and the housing 102. A new insert containing a full bladder of wine is then partially disposed within the barrel and the shroud. The male connector 152, which comes already connected to the bladder 132, is then attached to the female connector 154 and the insert 130 is pushed fully within the shroud 122 with the telescoping conduit 136 decreasing in overall length. The back cover 108 is replaced and the apparatus 100 or 200 is again ready to dispense the wine through the spigot 106. Upon activating the thermoelectric heat pump 112, the wine within the insert 130 is storable at a constant temperature for up to 8 weeks.

Figure 11:
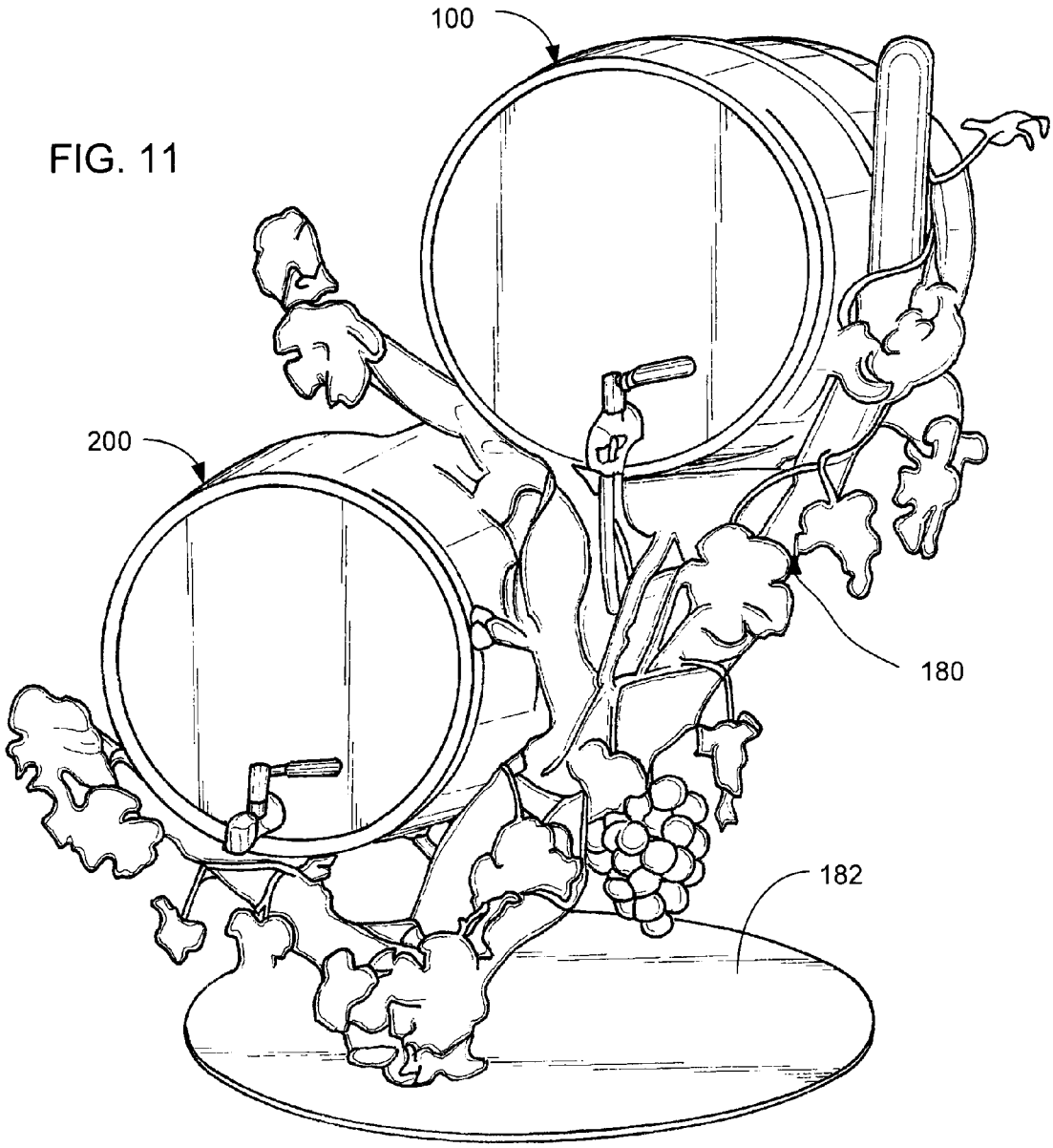
FIG. 11 is a perspective view of the first and second embodiments of the wine dispensing apparatuses of the present invention supported by a rotatable stand.

Another advantage of the present invention is that it permits ease of operation in an aesthetically pleasing manner without undue hardship in exchanging inserts. As illustrated in FIG. 11, apparatus 100, apparatus 200, or both, can be positioned on a rotatable stand 180, which in turn can be set up on a table, bar top or other suitable location. The stand may include a rotatable base 182, which when the wine in the bladder goes empty, can simply be rotated around to give a person access to the rear of the housing without having to lift and move the housing itself. A depleted insert can be exchanged with a full insert in the manner as previously described, whereafter the stand can be rotated back to its desired position.

Although the present invention has been described with reference to preferred embodiments, workers skilled in the art will recognize that changes may be made in form and detail without departing from the spirit and scope of the invention.

The invention claimed is:

1. A system for storing and dispensing wine comprising:
- a housing formed substantially in the shape of a wine barrel, the housing including a circumferential wall, a first closed end and a second open end;
- a spigot for selectively dispensing wine, the spigot supported by and positioned through the first closed end of the housing;
- a removable insert disposable within the housing through the second open end, the insert comprising:
  - a rectangular base member;
  - a first semi-circular end wall extending from the base member;
  - a second semi-circular end wall extending from the base member, the first end wall and the second end wall opposing one another, the first end wall having a greater radius than the second end wall; and
  - a circumferential wall extending from the base member between the first end wall and the second end wall, wherein the base member extends at a declining angle from the second end wall towards the first end wall, wherein the insert disposes within the housing to position the second end wall proximate the first closed end, wherein wine contained within the bladder is gravitationally drawn towards the port positioned proximate the first end wall opposite the spigot, the insert containing a collapsible bladder of wine with a port for dispensing the wine, the wine dispensing port positioned proximate the second open end opposite the spigot with the insert disposed within the housing; and
- a conduit extending from the first closed end toward the second open end, the conduit in fluid communication with the spigot, whereupon disposing the insert within the housing, the conduit is connectable to the port wherein the wine is selectively dispensed from the spigot.

2. The system of claim 1 wherein the conduit is a telescoping conduit positionable between a first retracted position and a second extended position, wherein disposing the insert through the second open end of the housing, the conduit is positionable toward the second extended position to facilitate connection with the port, wherein fully disposing the insert within the housing the conduit is positionable toward the first retracted position.

3. The system of claim 2 wherein the telescoping conduit includes a first length of tubing disposed within a second length of tubing, the first length of tubing slidably engageable with the second length of tubing.

4. The system of claim 1 and further comprising a refrigerating mechanism to chill wine contained within the insert, the refrigerating mechanism comprising:

a heat pump extending through an aperture contained within a bottom portion of the housing;

a thermally conductive block engaged to the heat pump; and a thermally conductive shroud supported by the block, the shroud having a rectangular base and circumferential wall configured to receive and support the insert.

5. The system of claim 4 wherein the shroud base extends within the housing from the first closed end to the second open end at a declining angle.

6. The system of claim 4 and further comprising insulation positioned between an outer surface of the shroud and an inner surface of the housing.

7. An apparatus for refrigerating and dispensing pre-packaged wine, the apparatus comprising:

a housing formed substantially in the shape of a wine barrel, the housing including a first circumferential wall, a first closed end and a second open end;

a thermally conductive shroud connected to the heat pump, the shroud having a rectangular base and a second circumferential wall configured to conform with the first circumferential wall of the housing, the shroud for receiving an insert containing the pre-packaged wine;

an electric heat pump extending through an aperture contained within a bottom portion of the housing, the heat pump for expelling thermal energy out of the housing;

a spigot for selectively dispensing wine, the spigot supported by and positioned through the first closed end of the housing below the rectangular base of the shroud;

a conduit positioned below the rectangular base of the shroud extending from the spigot toward the second open end, wherein the insert containing the pre-packaged wine disposes within the housing through the second open end to be received by the shroud, wherein the conduit is fluidly connectable to the insert proximate the open end of the housing, wherein the conduit is a telescoping conduit positionable between a first retracted position and a second extended position, wherein disposing the insert through the second open end of the housing, the conduit is positionable toward the second extended position to facilitate fluid connection with the insert, wherein fully disposing the insert within the housing the conduit is positionable toward the first retracted position.

8. The apparatus of claim 7 wherein the telescoping conduit includes a first length of tubing disposed within a second length of tubing, the first length of tubing slidably engageable with the second length of tubing.

9. The apparatus of claim 7 and further comprising a thermally conductive block engaged to the heat pump and supporting the shroud, wherein the block contains an aperture, wherein the conduit disposes through the aperture.

10. The apparatus of claim 7 and further comprising insulation positioned between an outer surface of the shroud and an inner surface of the housing.

* * * * *